US012669247B2

(12) United States Patent
Tserendorj et al.

(10) Patent No.: US 12,669,247 B2
(45) Date of Patent: Jun. 30, 2026

(54) DEVICE FOR REBURNING FURNACE COMBUSTION PRODUCTS

(71) Applicants: Munkhbaatar Tserendorj, Ulaanbaatar (MN); Buyan-Ochir Mishigdorj, Ulaanbaatar (MN); Zorigt Tserendorj, Ulaanbaatar (MN); Aleksandra Sergeevna Badmaeva, Ulaanbaatar (MN)

(72) Inventors: Munkhbaatar Tserendorj, Ulaanbaatar (MN); Buyan-Ochir Mishigdorj, Ulaanbaatar (MN); Zorigt Tserendorj, Ulaanbaatar (MN); Aleksandra Sergeevna Badmaeva, Ulaanbaatar (MN)

( * ) Notice: Subject to any disclaimer, the term of this patent is extended or adjusted under 35 U.S.C. 154(b) by 868 days.

(21) Appl. No.: 17/920,467

(22) PCT Filed: Apr. 19, 2021

(86) PCT No.: PCT/IB2021/053214
§ 371 (c)(1),
(2) Date: Oct. 21, 2022

(87) PCT Pub. No.: WO2021/214633
PCT Pub. Date: Oct. 28, 2021

(65) Prior Publication Data

US 2023/0175697 A1 Jun. 8, 2023

(30) Foreign Application Priority Data

Apr. 22, 2020 (RU) ..... RU2020114384

(51) Int. Cl.
*F24B 1/191* (2006.01)
*F24B 5/02* (2006.01)
*F24C 1/02* (2021.01)

(52) U.S. Cl.
CPC ..... *F24B 1/191* (2013.01); *F24B 5/028* (2013.01); *F24C 1/02* (2013.01)

(58) Field of Classification Search
CPC ..... F24B 1/191; F24B 5/028; F24B 5/025; F23B 10/02; F23L 9/02
See application file for complete search history.

(56) References Cited

U.S. PATENT DOCUMENTS 4,175,919 A * 11/1979 Matsumoto ..... F23D 14/02 431/114
4,300,460 A * 11/1981 Lamb ..... F23G 5/50 110/283

(Continued)

FOREIGN PATENT DOCUMENTS

CN 204201946 U 3/2015
CN 205174452 U 4/2016

(Continued)

*Primary Examiner* — David J Laux
(74) *Attorney, Agent, or Firm* — Nath, Goldberg & Meyer; Joshua B. Goldberg

(57) ABSTRACT

The invention relates to auxiliary equipment for reburning combustion products. The technical result is that of accelerating the ignition of fuel and improving fuel combustion in a furnace. A device for reburning combustion products in a furnace is arranged above a combustion unit inside the body of the furnace and is in the form of a hollow body with a bottom inlet hole and a top outlet hole, on the side wall of which hollow body there is formed a horizontal row of evenly distributed air holes. Rectangular protrusions are formed to the right- and left-hand sides of each hole on the inside of the body of the device, said protrusions serving to feed supplementary air, which comes in via the holes, from the outer holes of the furnace into the body of the device, providing for accelerated incineration of residual combustion products without formation of a vortex in the air flows.

4 Claims, 4 Drawing Sheets

(56) References Cited

U.S. PATENT DOCUMENTS

| | | | | |
|---|---|---|---|---|
| 4,502,395 | A * | 3/1985 | Barnett | F24B 1/006 126/77 |
| 5,203,316 | A * | 4/1993 | Pritchett | E04H 15/26 126/30 |
| 2021/0317985 | A1* | 10/2021 | Watteau | F23L 1/00 |
| 2025/0093037 | A1* | 3/2025 | Goldberg | F24B 1/26 |

FOREIGN PATENT DOCUMENTS

| | | | |
|---|---|---|---|
| RU | 188910 | U1 | 4/2019 |
| SU | 2456 | A1 | 9/1924 |
| SU | 1395902 | A2 | 5/1988 |

* cited by examiner

DEVICE FOR REBURNING FURNACE COMBUSTION PRODUCTS

This is a National Phase Application filed under 35 U.S.C. 371 as a national stage of PCT/IB2021/053214, filed Apr. 19, 2021, an application claiming the benefit of Russian application No. 2020114384 filed Apr. 22, 2020, the content of each of which is hereby incorporated by reference in its entirety.

DESCRIPTION OF THE INVENTION

The present invention relates to furnaces, in particular to a device for reburning furnace combustion products. The device for reburning products of combustion is designed to operate with homogeneous solid fuels.

At present, heating furnaces/boilers are widely used by consumers, but it has a number of disadvantages described as follows:

First. The upper air hole on the existing combustion device is connected to the vertical wall of the combustion unit of the furnace, symmetry of the combustion device is symmetrical to the vertical walls of the combustion unit. When burning going on, relatively thin part of the vertical wall of the combustion device heated up, therefore the temperature of the air holes of the combustion device initially does not meet the ignition temperature requirements, especially when the furnace is started up for the first time smoke comes out of the furnace and the smoke caused by slow ignition and will affect to continuous gasification process. As a result, the fire is extinguished when combustion takes place.

Second. Existing boilers, relatively large dimensions: all existing boilers mounted an auxiliary combustion device, since the air acts on the main part of the combustion unit of the furnace there are several disadvantages of this auxiliary combustion device: 1 At the lower end of the auxiliary device possesses air holes where there is the location of the highest temperature of the furnace, for the reason of very high airflow rate, this location is not suitable for ignition of combustion products in the air holes, also it may slow down gas conversion process. 2. The upper and lower ends of the auxiliary combustion device form plates directed to the vertical wall of the combustion unit causing an accumulation of ashes from above. The lower end is in a high-temperature zone of the combustion units, so it can be easily burned out shortening the term of exploitation of the auxiliary combustion device.

Third. In the part which the upper end of the auxiliary combustion device extended outward causes complexity with the ignition process in the air hole of the auxiliary combustion device as a result relatively low rate of air condensation.

The purpose of the present invention is to arrange a combustion device above a combustion unit inside the body of existing furnaces or to develop and new furnaces/boilers. The intention of this invention is to solve practical problems of existing furnaces/boilers such as slow ignition, smoke emission, and continuous combustion of fuel. The practical use of combustion products reburning device allows faster ignition of combustion products in the air hole and enhances the gas conversion and smokeless process and effective environmental protection, also the long-term of exploitation of the combustion device.

As described in Chinese patent CN205174452 dated Apr. 20, 2016 a furnace is designed with an additional combustion chamber arranged above the main combustion chamber for the purpose of more efficient combustion of fuel. At the same time, the additional combustion chamber is cone-shaped with vertically oriented upper and lower holes. The implementation of the device for reburning of the combustion products, namely the additional chamber with vertically oriented holes leads to uneven air flow into the additional combustion chamber which causes insufficient combustion of the fuel.

The closest technical solution is the Chinese patent CN204201946 dated Mar. 11, 2015, which discloses a device for reburning combustion products. The device consists of a conical hollow combustion housing with horizontal row air holes distributed in the middle of the device housing. The disadvantage of this solution is the insufficient supply of air for ignition combustion products because airflow from adjacent air holes causes the formation of an air vortex.

The purpose of this technical solution is to avoid above described disadvantages.

The purpose of the present invention is to arrange a combustion device above a combustion unit inside the body of existing furnaces or to develop improved and new furnaces/boilers. The intention of this invention is to solve practical problems of existing furnaces/boilers such as slow ignition, smoke emission, and continuous combustion of fuel. The practical use of combustion products reburning device allows rapid ignition of combustion products in the air hole and enhances the gas conversion and smokeless process, effective environmental protection, and also the long-term of exploitation of combustion products reburning device.

The technical effect of the invention: acceleration of ignition of combustion products in the air hole of the device and improvement of fuel combustion in the furnace.

The technical result is achieved by the fact that the device for reburning the combustion products is in the form of a hollow body with a bottom inlet hole and a top outlet hole, on the side wall of which hollow body there is formed horizontal rows of evenly distributed air holes. At the same time, rectangular protrusions are formed to the right- and left-hand sides of each hole on the inside of the body of the device.

Generally, the flat rectangular protrusions are parallel to each other.

The body of the device can be designed in the form of a truncated cone or a truncated pyramid or a truncated parallelepiped or cylinder or other designs suitable for assemble to the hearth.

The thickness of the rectangular protrusion is preferably less than the thickness of the combustion device.

The shown numbers in the figures referring to the following references.

1—ceramic hearth;
2—cast iron fire grate,
3—furnace ashtray;
4—outer air holes;
5—air holes of the proposed device;
6—furnace cast-iron covers;
7—air chamber;

8—flue;
9—flue groove;
10—soot withdrawal opening;
11—fuel loading door;
12—device for returning combustion products;
13—furnace body;
14—housing of the device reburning furnace combustion products;
15—auxiliary protrusion (shutter) of the device for reburning furnace combustion products.

SUBSTANTIVENESS OF THE PROPOSED INVENTION

Figure 3:
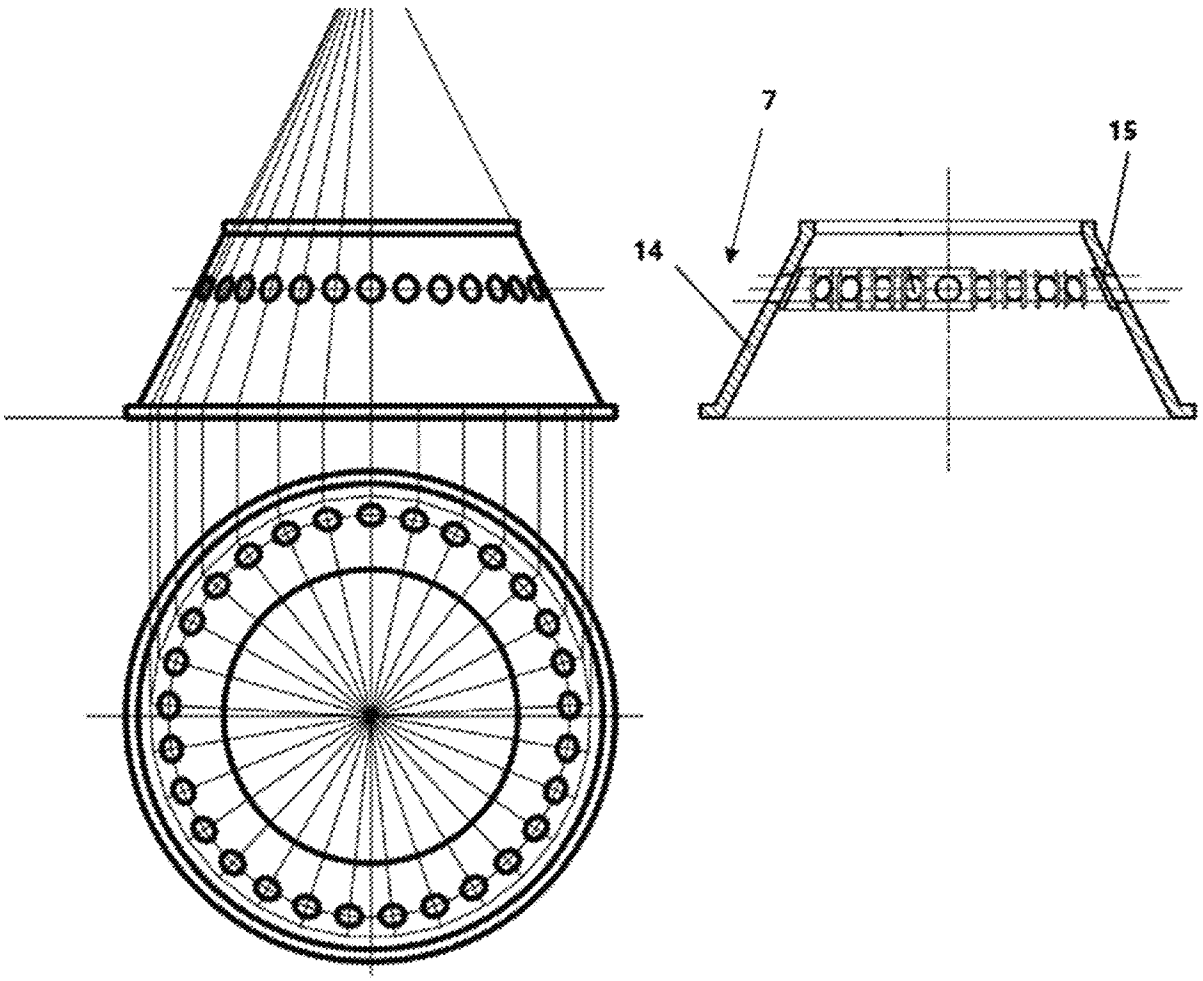
FIG. 3—drawing of the proposed device (cone-shaped)
Figure 4:
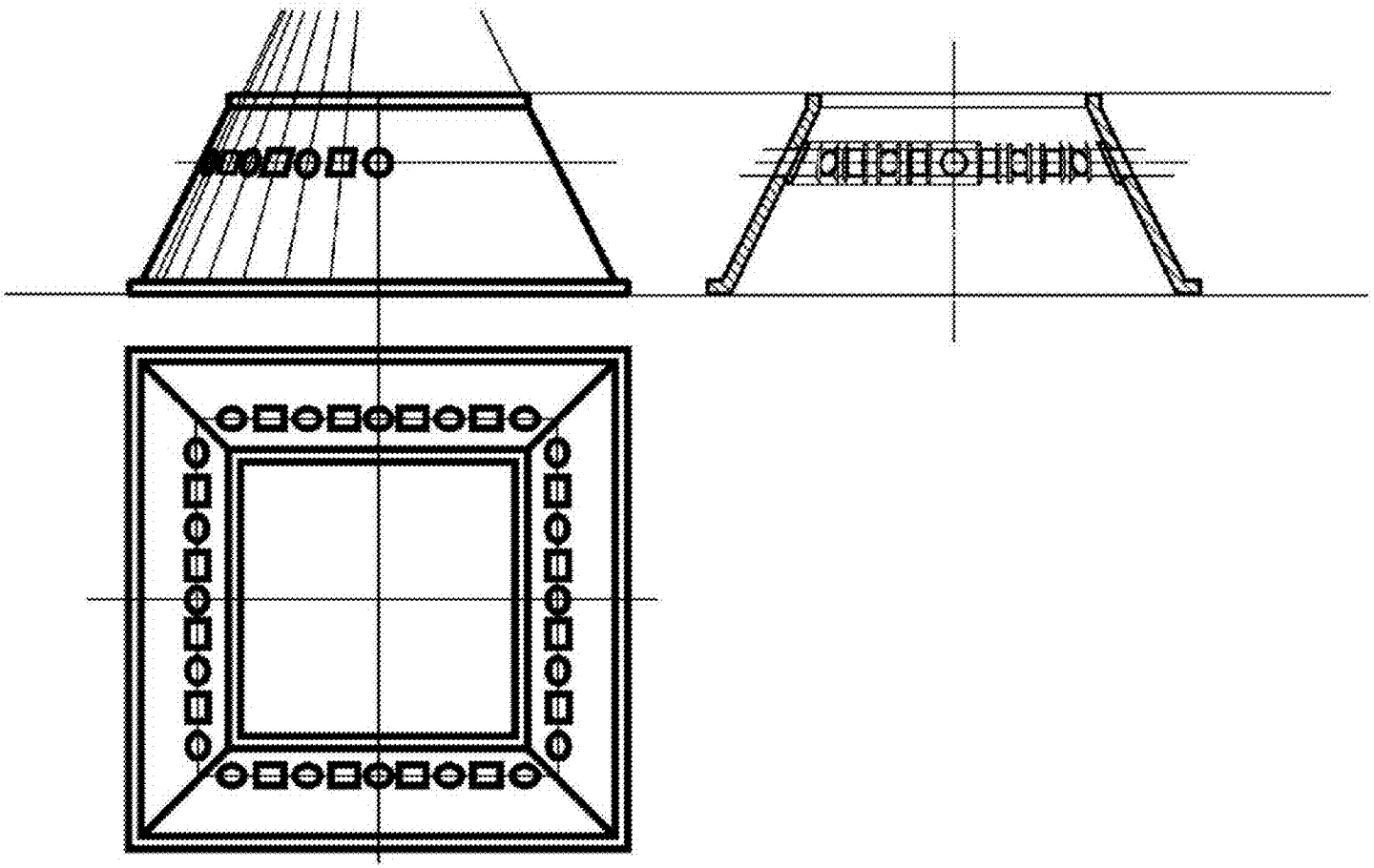
FIG. 4—drawing of the proposed device (pyramidal).

The combustion product reburning device is composed of a combustion housing 14 and air holes 5 (see FIG. 3), the form of a device varies on the design of the combustion furnace.

The auxiliary protrusions (shutter) of the device for reburning furnace combustion products 15 are formed on the inside of the body of the device 14 to the right- and left-hand sides of each air hole 5, said protrusions vertically positioned on the wall of the combustion device 14. The auxiliary protrusions (shutters) of each hole arranged parallelly to each other, but not necessarily be designed strictly vertically. The height of the protrusion (1-2 cm), generally, does not exceed the diameter of the air hole.

Figure 2:
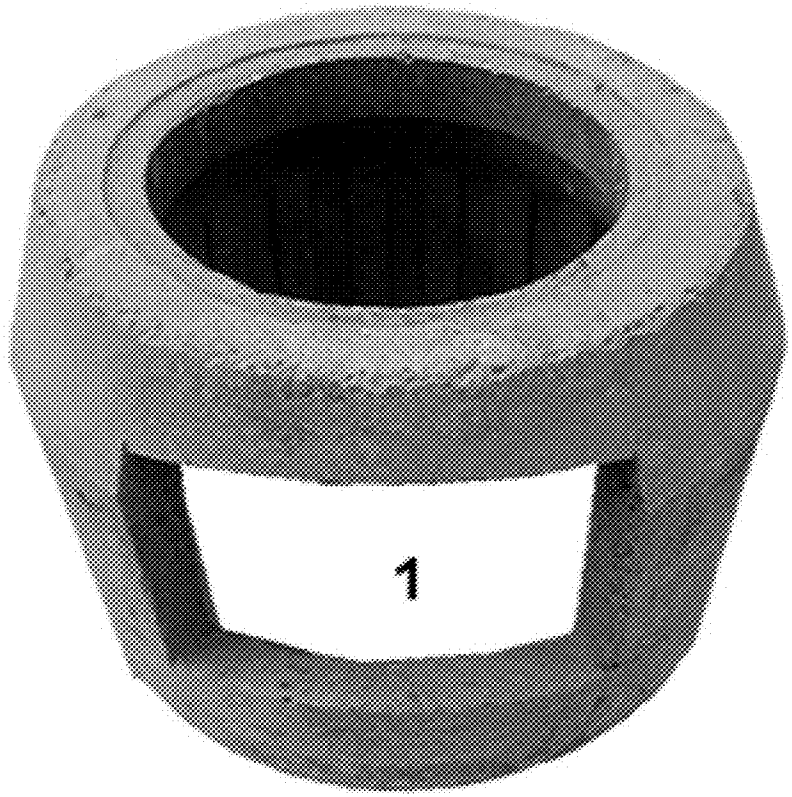
FIG. 2—the embodiment of the device and the hearth on which the device should be assembled.
Figure 2:
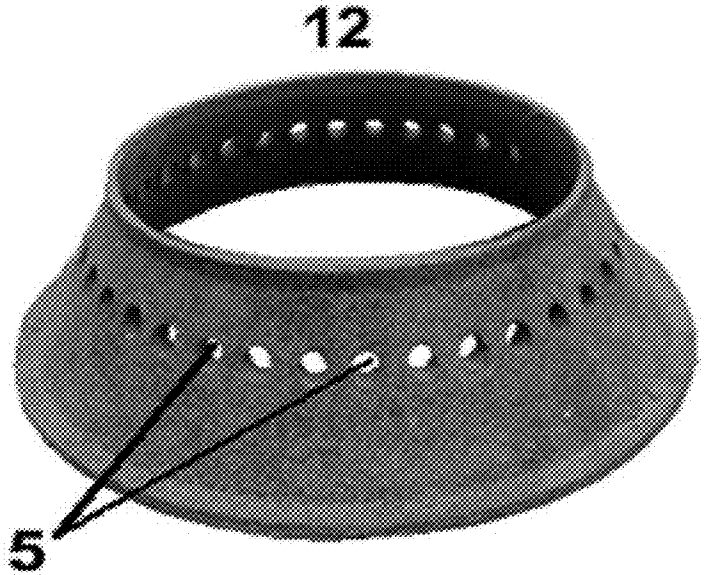

Description of the embodiment use of the device in a domestic heating furnace (FIG. 2):

When fuel combustion occurs in furnace 13, smoke goes up to the reburning device 12 and burns in there, as a result of supplementary air distributed from outside though air hole.

Protrusions of the device are formed on the inside of the body, and the thickness of the protrusions is less than in comparison to the thickness of the body of the device itself. The device for reburning combustion products 12 is assembled above the ceramic hearth (furnace combustion unit) 1 inside the furnace body.

Air holes 5 is formed a horizontal row evenly distributed on the side wall of the device 15. Air chamber 7 is located at the same level as air holes 5 and freely supplies air to air holes 5. The thickness of protrusions are relatively thin so that during fuel combustion the temperature of the chamber momentarily rises up to the required ignition temperature, and the ignition process is not only rapid, but also smokeless, and complete combustion of the fuel takes place, which corresponds to the ecological requirements.

Figure 1:
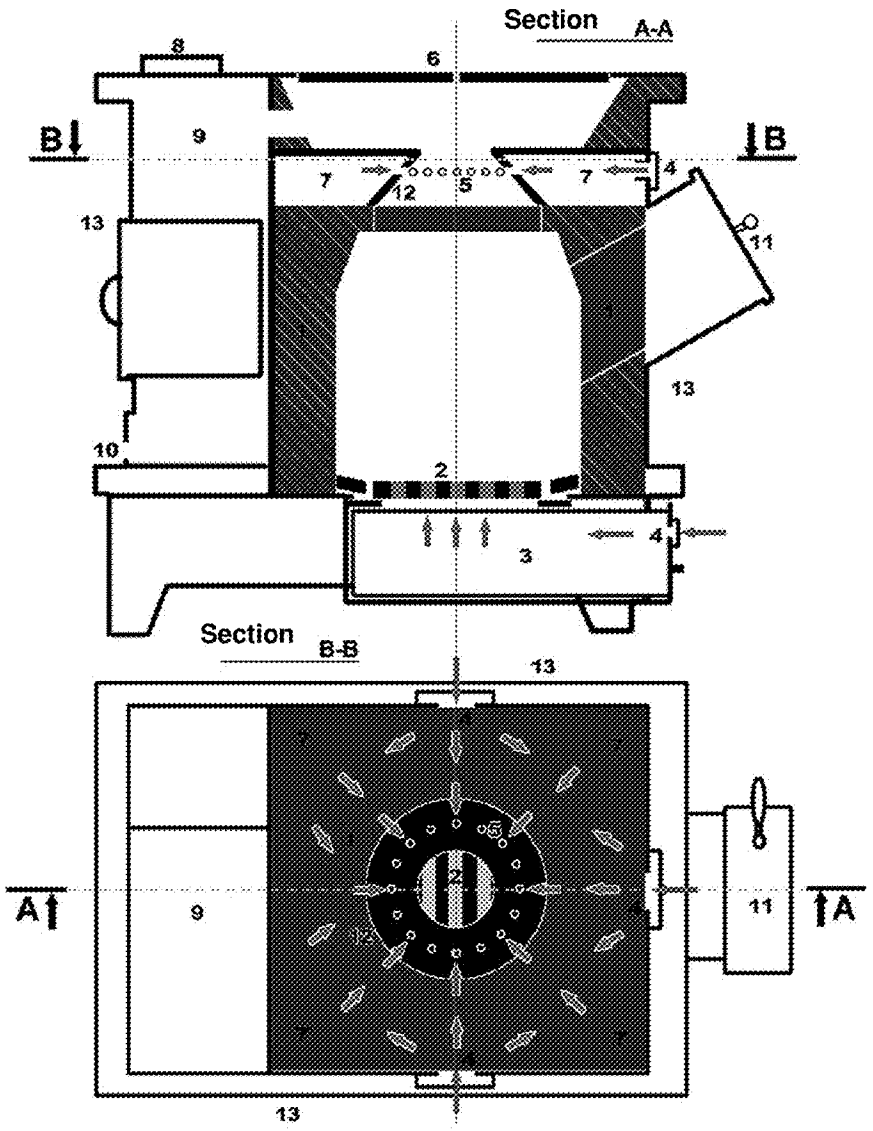
FIG. 1—reburning process of combustion products in a furnace.

The housing of combustion device 14 has protrusions (auxiliary combustion device) with the help of which distributed supplementary air entering from the outer air hole of the furnace to combustion housing 14 (FIG. 1), as a result provides accelerated combustion of the residual combustion products (smoke).

The housing of the combustion products reburning device may be designed with a conical form or a spherical column form, a square form or square conical form, a rectangular form, and other forms depending on the form of the furnace.

The presented device for reburning of combustion products is produced industrially from cast iron or iron (on special equipment for metalworking), the quality and exploitation term depends on the quality of the metals.

Implementation of this solution has a wide application, its design is simple, and its production is not complicated.

The thickness of device is relatively thin so when fuel combustion takes place the temperature in the chamber instantly rises up to the required ignition temperature, and the combustion process is not only rapid, but also smokeless, and complete combustion of the fuel takes place, which corresponds to the ecological requirements.

The invention claimed is:

1. Device for reburning furnace combustion products is arranged above a combustion unit in the form of a hollow body with a bottom inlet hole and a top outlet hole, on the side wall of which hollow body there is formed a horizontal row of evenly distributed air holes, wherein, rectangular protrusions are formed to the right- and left-hand sides of each air hole on the inside of the body of the device said rectangular protrusions serving to feed supplementary air, which comes in via the air holes, from the outer holes of the furnace into the body of the device, providing for accelerated incineration of residual combustion products without formation of a vortex in the airflow.

2. The device according to claim 1, wherein the rectangular protrusions are parallel to each other.

3. The device according to claim 1, wherein the body of the device is designed in the form of a truncated cone and/or a truncated pyramid and/or a truncated parallelepiped and/or a cylinder.

4. The device according to claim 1, wherein the thickness of the rectangular protrusions is less than the thickness of the body of the device.

* * * * *